US011142910B2

(12) United States Patent
Kanawyer

(10) Patent No.: US 11,142,910 B2
(45) Date of Patent: Oct. 12, 2021

(54) ABUTTING IRREGULAR HEXAGONS AS BEAM TIES FOR A DUAL BEAM JOIST SUPPORTING A TRUSS

(71) Applicant: Don Kanawyer, Santa Clara, CA (US)

(72) Inventor: Don Kanawyer, Santa Clara, CA (US)

( * ) Notice: Subject to any disclaimer, the term of this patent is extended or adjusted under 35 U.S.C. 154(b) by 0 days.

(21) Appl. No.: 16/707,500

(22) Filed: Dec. 9, 2019

(65) Prior Publication Data

US 2021/0172173 A1 Jun. 10, 2021

(51) Int. Cl.

| | |
|---|---|
| ***E04C 3/02*** | (2006.01) |
| ***E04C 3/12*** | (2006.01) |
| ***E04C 3/11*** | (2006.01) |
| ***E04C 3/17*** | (2006.01) |
| *E04C 3/04* | (2006.01) |

(52) U.S. Cl.

CPC ..... *E04C 3/11* (2013.01); *E04C 3/17* (2013.01); *E04C 2003/0486* (2013.01)

(58) Field of Classification Search

CPC ..... E04C 3/11; E04C 3/12; E04C 3/17; E04C 2003/0486; E04C 2003/0491

USPC ..... 52/633, 634, 690, 691, 693, 696

See application file for complete search history.

(56) References Cited

U.S. PATENT DOCUMENTS 2,385,142 A * 9/1945 Lank ..... E04C 3/17 52/639
2,457,056 A * 12/1948 Macomber ..... E04C 3/11 52/639
3,867,803 A * 2/1975 Platt ..... E04C 3/18 52/693
4,274,241 A * 6/1981 Lindal ..... E04B 1/26 411/461
4,348,850 A 9/1982 Reeder et al.
4,414,787 A * 11/1983 Kappen ..... E04C 3/17 52/639
4,523,419 A * 6/1985 Palacio ..... E04C 3/292 52/690
4,541,218 A 9/1985 Gottlieb
5,457,927 A * 10/1995 Pellock ..... E04C 3/07 403/295
6,715,257 B2 4/2004 Kent et al.
6,758,022 B1 * 7/2004 Coll ..... E04C 3/09 52/638
7,513,085 B2 * 4/2009 Moody ..... E04B 9/00 52/635
8,156,706 B2 * 4/2012 Moody ..... E04C 3/11 52/639
9,670,676 B2 * 6/2017 Sirowatka ..... E04C 3/16
2002/0059774 A1 * 5/2002 Collins ..... E04C 3/07 52/690

(Continued)

*Primary Examiner* — Brian E Glessner
*Assistant Examiner* — James J Buckle, Jr.
(74) *Attorney, Agent, or Firm* — Thomas Schneck

(57) ABSTRACT

A roof structure supporting a roof comprising a truss and a joist supporting the truss, the joist having two elongated wooden beam members on the bottom of the truss connected with beam tie members comprised of a pair of congruent truncated mirror image parallelograms forming hexagons with mutually facing and abutting portions. Each beam tie member is connected to outer sides of top and bottom elongated wooden beams and is adjacent to the next beam tie connected to outer sides of top and bottom elongated wooden beams. The tied beams allow use of smaller, less expensive beam members yet providing good truss support in a joist.

20 Claims, 4 Drawing Sheets

(56) References Cited

U.S. PATENT DOCUMENTS

| | | | | |
|---|---|---|---|---|
| 2002/0073643 | A1* | 6/2002 | Snow | E04C 3/17 52/690 |
| 2002/0092259 | A1* | 7/2002 | Crawford | E04C 3/02 52/696 |
| 2004/0172911 | A1* | 9/2004 | Tadich | E04C 3/11 52/633 |
| 2004/0194412 | A1* | 10/2004 | Sandoz | E04C 3/16 52/633 |
| 2004/0211146 | A1* | 10/2004 | Weeks | E04C 3/40 52/633 |
| 2004/0261350 | A1* | 12/2004 | Tadich | E04C 3/292 52/633 |
| 2005/0086893 | A1* | 4/2005 | Moody | E04C 3/11 52/633 |
| 2006/0123733 | A1* | 6/2006 | Moody | E04C 3/11 52/634 |
| 2006/0150560 | A1* | 7/2006 | Hughes | E04C 3/11 52/633 |
| 2009/0193727 | A1* | 8/2009 | Moody | E04B 9/00 52/90.1 |
| 2009/0293408 | A1* | 12/2009 | Legnini | E04C 3/17 52/643 |
| 2011/0252724 | A1* | 10/2011 | Heisler | F24S 25/40 52/173.3 |
| 2011/0277416 | A1* | 11/2011 | Dunbar | E04C 3/07 52/634 |

* cited by examiner

ABUTTING IRREGULAR HEXAGONS AS BEAM TIES FOR A DUAL BEAM JOIST SUPPORTING A TRUSS

TECHNICAL FIELD

The invention relates, in general, to roof trusses, and, specifically, to improvements in joists for trusses.

BACKGROUND ART

Roof trusses are assemblies that are typically prefabricated then installed in buildings at regular intervals to provide roof support. Common trusses include triangular webs forming a truss frame which assist in providing support to the roof by bearing structural loads. Some common truss assemblies have a pair of sloped top chords meeting at a peak point with web members in between that join chords to form triangular patterns typical of trusses.

FIGS. 1A-I shows example prior art trusses known in the art. Specifically, trusses 100, 102, 104, 106, 108, 110, 112, 114, and 116 are known as the Fink, Double W, Fan, Howe Girder, Flat Top, Raised Tie Scissors, Scissors, Clerestory and Raised Tie, respectively. Each truss in FIGS. 1A-I includes a frame with one of a first top sloped chord member 117, 119, 121, 123, 125, 127, 129, 131 and one of a respective second top sloped chord member 133, 135, 137, 139, 141, 143, 145, 147, 149 meeting at a peak. A beam web 151, 153, 155, 157, 159, 161, 163, 165, 167 joins top truss chord members to one of bottom truss chords 122, 124, 126, 128, 130, 132, 134, 136, 138 to form the triangular patterns that carry loads.

Large wooden beam members, having a width of 10 inches or more, have often been used as joists in supporting trusses where large loads are encountered. However, such large wooden beam members, though able to bear large loads over a large spanning distance, are often difficult or expensive to acquire. Alternatively, smaller wooden members, such as 2-by-4 wooden beams (typically 1½ inches thick and 3 inches wide), have been used in fabricating joists for trusses as they are easier to supply than larger beams of wood. However, 2-by-4 wooden beams are not always able to withstand large loads that joists for trusses are often needed to bear. This is especially true where the joists span a long distance and must support a truss load over this longer distance.

The following patents describe support devices for trusses to assist in supporting a roof and bearing large loads. U.S. Pat. No. 4,541,218 to Gottlieb describes a plurality of V-shaped metal web members for forming a truss or joist assembly. Metal web members are placed in the spacing between wooden members and have their extremities connected to the wooden members. Each metal web member has connector nail plates located at the apex and at extremities. Each of the connector plates at the two extremities is connected to the apex connector plate by leg members. A series of metal web members are arranged on each side of the two wooden members so that the extremities are approximately adjacent to each other. The number of metal web members depends on the length of the wooden members and the compressive loads the members will bear.

U.S. Pat. No. 4,348,850 to Reeder et al. describes a flat sheet metal structure web member for interconnecting parallel beams to form a floor joist or the like. The web member is generally V-shaped and includes teeth from opposite ends of the leg for being driven into the beams.

An object is to provide an improved roof support structure with lower cost joists and a method of fabricating an improved roof support structure, the roof support structure capable of bearing substantial structural loads.

Another object is to provide tie members for lower cost joists in a truss for roof support and a method of fabricating the joists for a roof support.

SUMMARY DISCLOSURE

These and other objectives are accomplished by a roof support structure featuring a truss with a joist using novel joist beam ties supporting the roof truss.

The joist comprises a pair of parallel, spaced apart smaller beams having coextensive lengths. They may optionally have the same widths and a height, the beams at least as long as the span of the truss where support is designed. The beams are stacked and joined along a non load bearing surface to form a heavier, larger joist. The joist is typically affixed to the lower ends of the top chords of the truss with, for example, TECO clips and nails. The beams forming the joist are spaced apart by a plurality of spaced apart blocks joined centrally to the beam at intervals. The beams are joined to each other with a plurality of beam tie members affixed along the length of the beams. Preferably the beam ties are tiled to have a corrugated shape along the beam length forming a truss joist. The beam ties are preferably plywood but may in other embodiments be comprised of metal, such as aluminum.

The beams ties are formed by pairs of congruent irregular hexagon tie members having a height that is approximately the same as the spaced apart beams. The beam tie pair members are symmetric truncated mirror image parallelograms forming the irregular hexagons. Truncation or slicing of a parallelogram by two parallel lines results in a hexagon. The members of each pair have mutually facing and abutting wedge shaped noses so that abutting ties transmit sideways loads and resist vertical compression. A running length of such abutting tie members can be tiled along the beams resembling a stiff corrugated structure that not only joins the parallel beams by tiling but resists vertical and lateral compression, as well as twisting. By "tiling" is meant that a side of one polygonal member abuts a corresponding side of another polygonal member. In one embodiment, at least one third of the height of the irregular hexagon member is abutting the other irregular hexagon member of the pair. The beam ties are secured to the beams by fasteners, for example, nails. In one embodiment, the beam tie pairs are adjacent to the next beam tie pair along the span of the beams to achieve tiling. In another embodiment, the beam ties are spaced apart along the span of the beams and are not tiled. An upper portion of the beam tie is connected to the upper beam of the pair of beams and a lower portion of the beam tie is connected to the lower beam. This arrangement provides a strong connection between beams forming a joist, improving load distribution and providing for strong roof support, even for long spanning trusses. On the reverse side of the joist, plywood straps may be secured to the joist beams at intervals to provide further support.

Various types of truss assemblies known in the art may be modified during fabrication of the roof support to include the joist with coextensive spaced apart beams and beam ties, as described above. Where the truss has a bottom chord such as bottom chord 122, 124, 126, 128, 130, 136 and 138 that extends in substantially a straight path from one point of the first sloped top chord member to another opposite point of the second sloped top chord member, such as seen in the Fink, Double W, Fan, Howe, Girder, Flat Top, Clerestory and Raised Tie, a bottom truss chord may form the top beam member of the joist beam member pairs. Another beam member is added below the top beam member and extends from one end of the first sloped top chord to the other end of the second sloped top chord to form the beam member pair. The sloped top chords may be elongated so that two joist beams may be affixed.

Where there is no bottom chord member in the truss that extends in substantially a straight path from one point of the sloped top chord member to another opposite point of the other top chord member, such as in the Raised Tie Scissors and Scissors trusses, two beams (rather than one) are added to the truss and affixed to, typically, the top chord members in forming a joist.

DETAILED DESCRIPTION

Figure 1A:
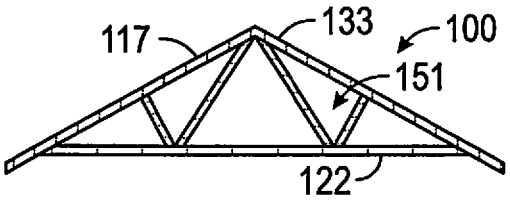
FIG. 1A (Prior Art)
FIGS. 1A-I are front views of prior art trusses known in the art.
Figure 1B:
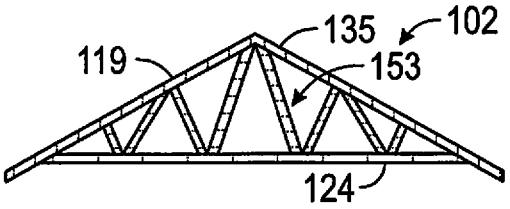
FIG. 1B (Prior Art)
Figure 1C:
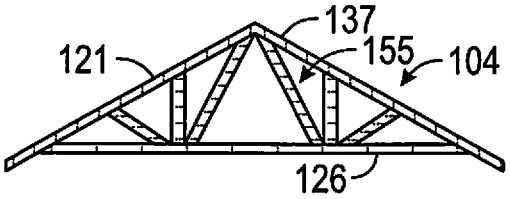
FIG. 1C (Prior Art)
Figure 1D:
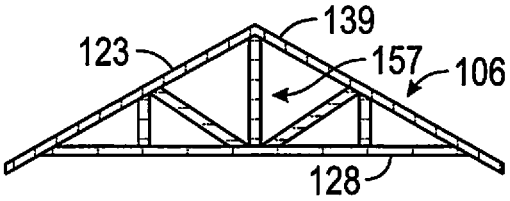
FIG. 1D (Prior Art)
Figure 1E:
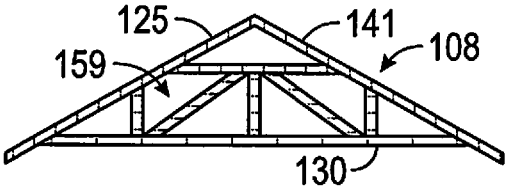
FIG. 1E (Prior Art)
Figure 1F:
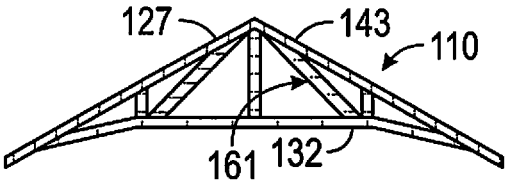
FIG. 1F (Prior Art)
Figure 1G:
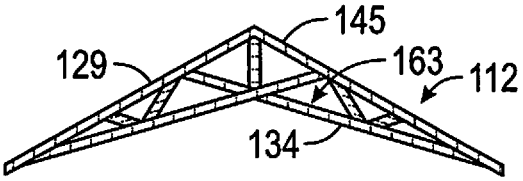
FIG. 1G (Prior Art)
Figure 1H:
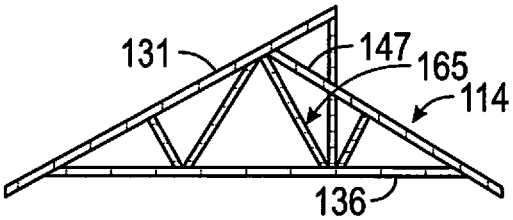
FIG. 1H (Prior Art)
Figure 1I:
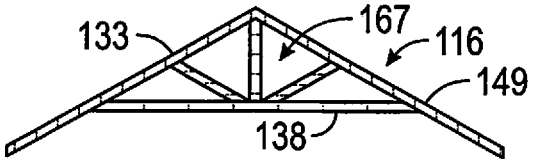
FIG. 1I (Prior Art)
Figure 2:
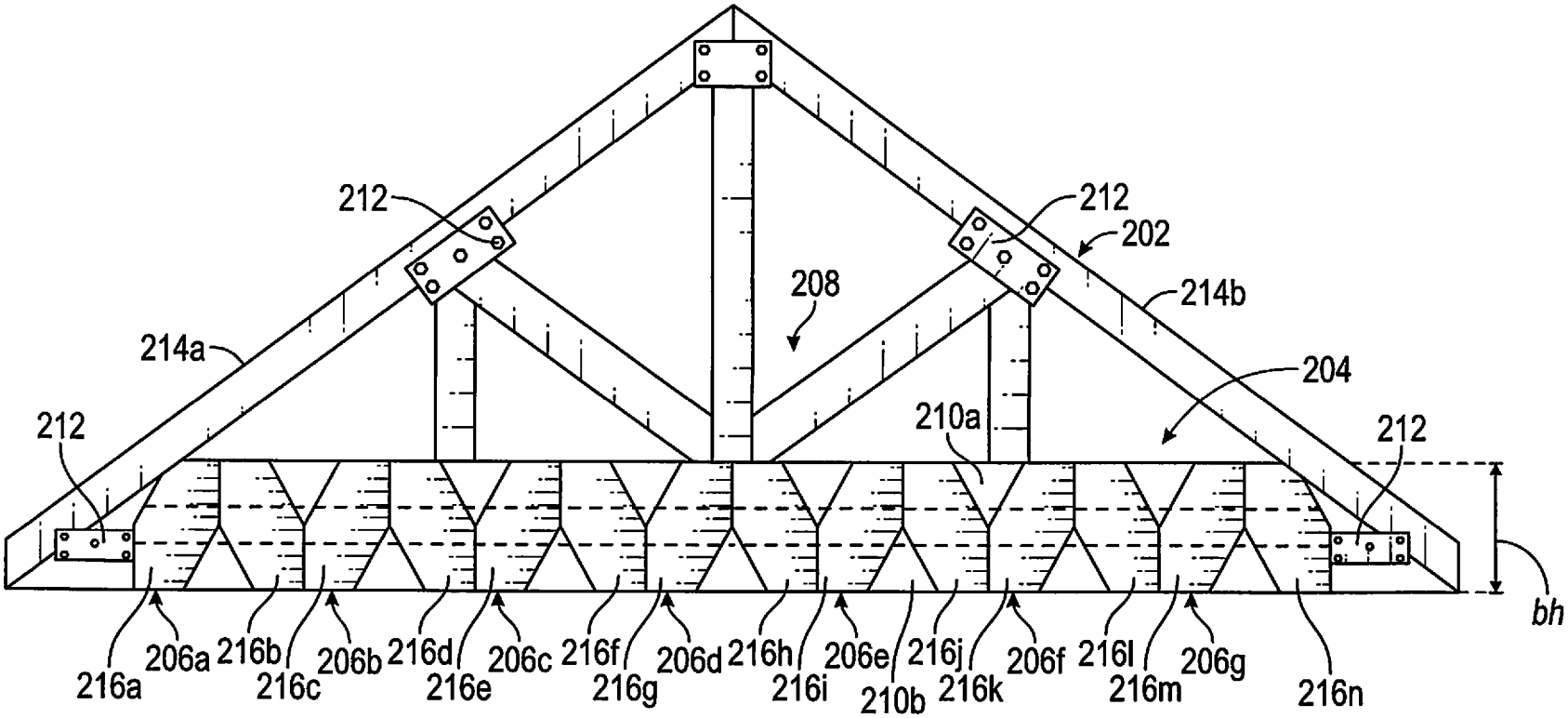
FIG. 2 is a front view of an embodiment of a roof structure featuring a roof truss with a joist.

With reference to FIG. 2, there is seen a roof structure 200 having a truss 202 and a joist 204 featuring beam ties 206*a-g* for strengthening the truss 202 for roof support. In a preferred embodiment, the truss and joist beams are made from lumber. The truss has a beam web 208 forming triangular patterns for carrying axial forces. This triangular pattern example is the same as that found in a Howe Girder truss depicted in FIG. 1E. Though this embodiment will be described with reference to the Howe Girder triangular beam web pattern, various truss beam web and truss designs may be strengthened by the joist described herein.

Figure 4:
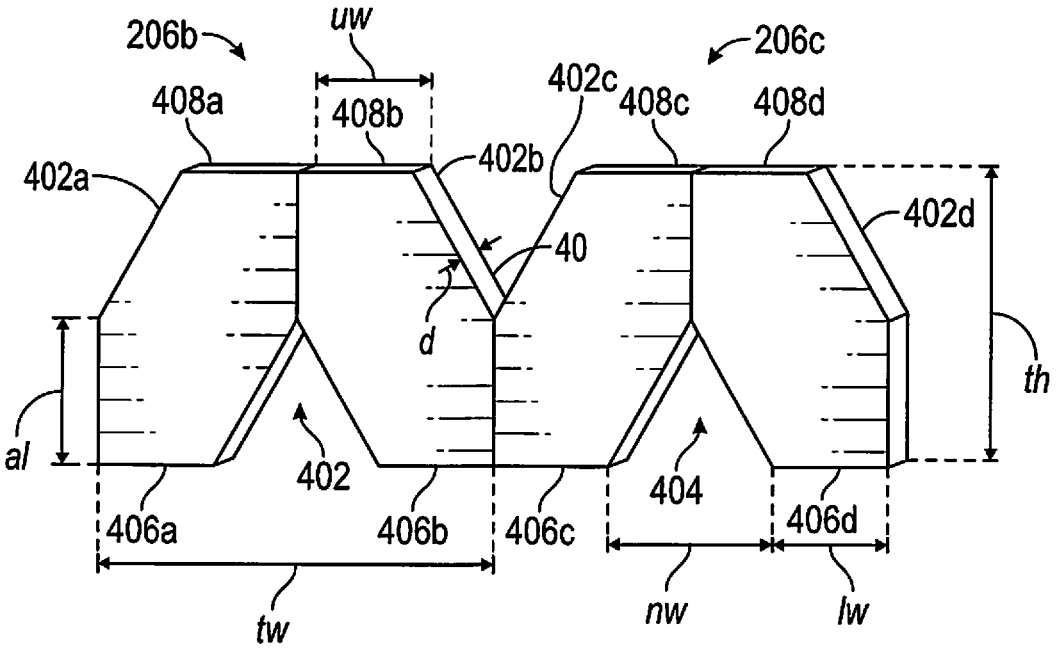
FIG. 4 a partial perspective view of two beam ties of FIG. 2 without joist beams.

As seen in FIG. 2, the joist 204 comprises a pair of coextensive, spaced apart beams 210*a* and 210*b* having parallel lengths, widths and a height, the lower beam beam 210*b* at least as long as the span of the truss and the upper beam 201*a* at least as long as a shorter span of the truss. With reference to FIG. 4, the dimensions of beam ties 206*b* and 206*c* are seen. Typically the dimensions of each beam tie are the same. Each beam tie has, in one example, a total height th of approximately 11 inches, a leg width lw for the lower flat sides 406*a*, 406*b*, 406*c*, 406*d* of approximately 3½ inches, a total width tw of approximately 12 inches, an upper width uw of approximately 2.5 inches for each of the upper flat sides 408*a*, 408*b*, 408*c*, 408*d*, a notch width nw of approximately 5 inches and a depth d of approximately inch. Lower sloping sides 400*a*, 400*b*, 400*c*, 400*d* of each beam tie forms a notch 402, 404 having, in one example, a notch of 60 degrees. Adjacent upper sloping sides 402*a*, 402*b*, 402*c*, 402*d* of beam ties form a notch when adjacent with another upper sloping side 404 having a notch angle of, for example 60 degrees. Notch angles are not critical. The length of the abutment al is, for example 4½ inches. The inner side length il is approximately 4½ inches.

Figure 5:
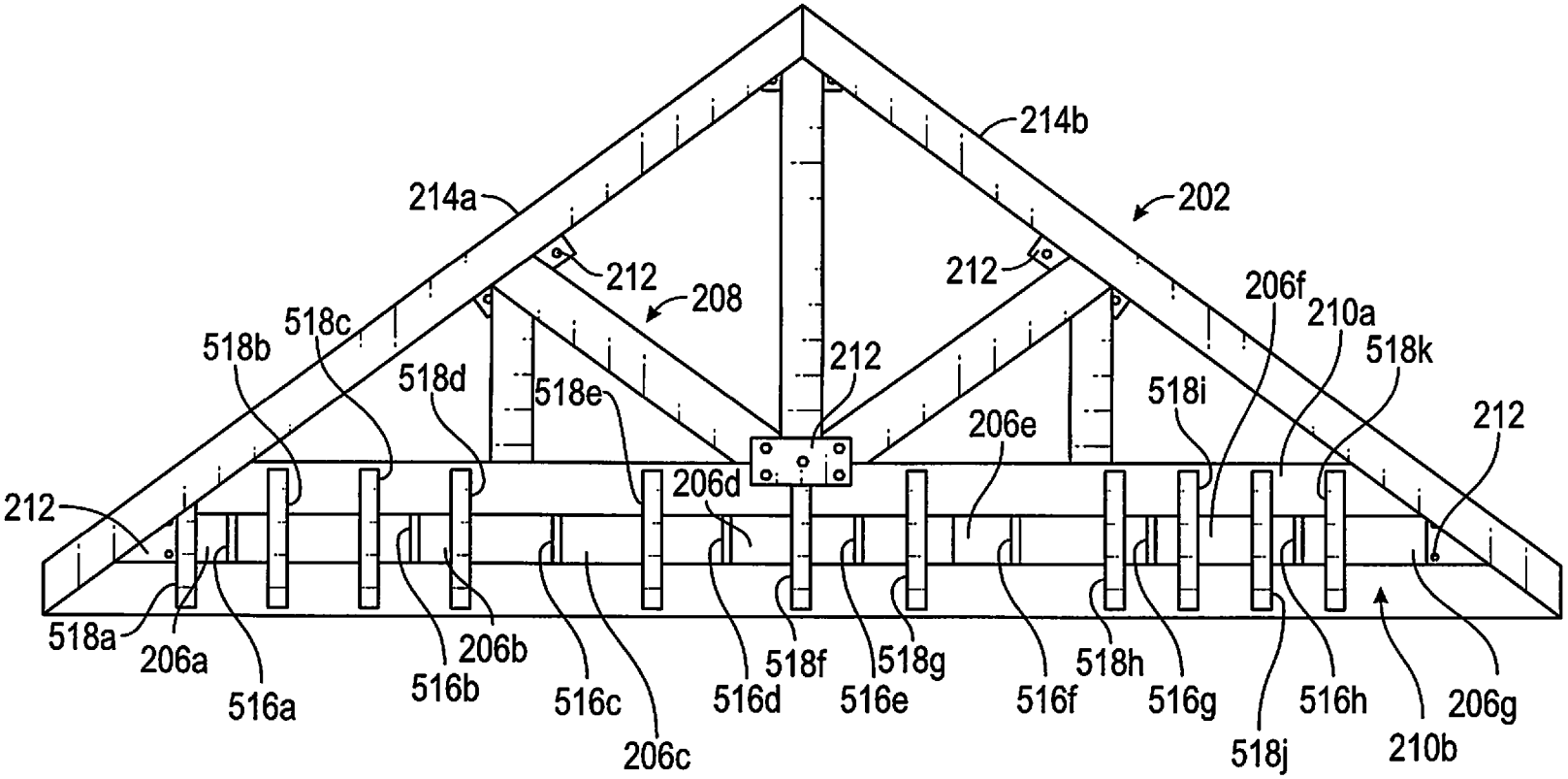
FIG. 5 is a rear view of the embodiment of the invention of FIG. 2.

As seen in FIGS. 2 and 5, the beams 210*a* and 210*b* are affixed to the truss 202, for example, using clips 212 such as metal TECO clips and nails. "TECO" was formerly a registered trademark for metallic wood beam connectors but now is generic for same. The web 208 is connected to the top chords 214*a* and 214*b* using, for example, clips 212. Where the truss has sloped top chords 214*a* and 214*b*, the beams 210*a* and 210*b* are connected, for example, at the lower ends of the top chords of the truss 202. Beam ties 206*a* and 206*g* have been trimmed on the ends. In other examples the beam ties on the end are not trimmed.

With reference to FIG. 5, the joist beams 210*a* and 210*b* are spaced apart by a plurality of spaced apart blocks 516*a-h* centered in and joined to beams 210*a* and 210*b* at intervals. In one example, the support blocks have a height of 4 inches, a width of 4 inches and a depth of 2 inches.

Referring back to FIG. 2, the beams are tied to each other with a plurality of beam ties 206*a-g* affixed along the length of the beams 210*a* and 210*b*. The beam ties may be nailed, adhered or otherwise affixed to the beam ties 210*a* and 210*b*.

Figure 3A:
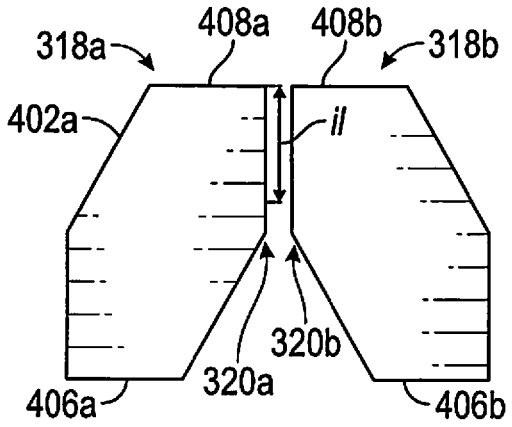
FIG. 3A is a front view of beam tie members.
Figure 3B:
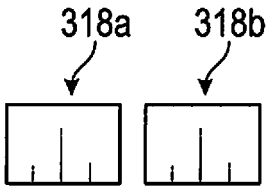
FIG. 3B is a top view of the beam tie members of FIG. 3A.
Figure 3C:
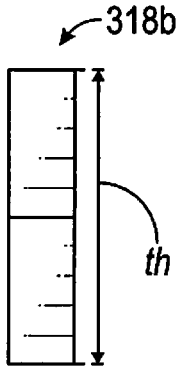
FIG. 3C is a side view of beam tie members of FIG. 3B.

With reference to FIGS. 3A-C, the beams ties 206*a-g* are each formed by a pair of congruent irregular hexagon members 318*a* and 318*b* that are joined to the beam members and placed adjacent to each other. In a preferred embodiment the beam ties are plywood. In other embodiments the beam ties may comprise metal, for example ⅛ inch thick aluminum. The hexagon members (and the beam ties they form) have a height th that is approximately the same as the spaced apart beams. The beam height bh, as seen in FIG. 2, is, for example, approximately 11 inches with approximately, for example, a 3 inch space s (FIG. 5) between beams. The beam tie pair members are symmetric truncated mirror image parallelograms forming the irregular hexagons. The members of each pair have mutually facing and abutting wedge shaped noses 320*a* and 320*b* that provide lateral, i.e., sideways, and torsional stability since pairs of abutting pieces form unitary structures by tiling. A running length of such tiled tie members resemble stiff corrugations applied to a non load bearing surface of a joist. In one example, at least one third of the height th of the irregular hexagon member 318*a* is abutting the other irregular hexagon member 318*b* of the pair.

In one embodiment, the beam tie pairs 206 are adjacent to the next beam tie pair 206 along the length of the beams 210*a* and 210*b*. In another example, the beam ties 206 are spaced apart along the length of the beams. An upper portion of the beam tie is connected to the upper beam 210*a* of the pair of beams and a lower portion of the beam tie is connected to the lower beam 210*b*. This arrangement provides load distribution to the legs 216*a-n* of the beam ties 206*a-g* and strengthens the truss 202 providing for strong roof support, even for long span trusses.

Referring to FIG. 5, on the other side of the joist, plywood straps 518*a-k* may be secured to the beams 210*a* and 210*b* at intervals to provide further support. In one example, the wooden support straps have a width of approximately 2½ inches, a height of approximately 11 inches and a depth of approximately ½ inches. The wooden support straps may be secured by for example, nails, or some other mechanism.

In a method of forming a joist for a truss, two parallel coextensive beams having a length spanning a truss dimension are stacked. The beams have a non load bearing surface. Ties are fastened to the beam and are tiled to have a corrugated shape along the beam length thereby forming a truss joist.

The number, size and spacing of the beam ties used may vary as can the truss web and frame design. Ancillary common TECO clips and nails are used where appropriate.

What is claimed is:

1. A roof structure comprising:

a roof truss made of beams having a width and a span; and a joist supporting the roof truss, that joist having, a pair of coextensive, spaced apart beams having parallel lengths, widths and a height, at least as long as the span of the truss, the beams spaced by a plurality of spaced apart blocks joined to the beams at intervals;

a plurality of beam ties affixed along the length of the beams, the beam ties being formed by pairs of congruent irregular hexagons having a height that is approximately the same as the spaced apart beams, the pairs being symmetric truncated mirror image parallelograms forming the hexagons with mutually facing and abutting noses, wherein the extent of nose-to-nose abutment of the noses is at least one-third of the height of the irregular hexagons, whereby the beam ties form tiles that abut the beams and mutually abut in the space between the beams thereby adding strength and load support to the joist.

2. The roof structure of claim 1, wherein the joist further comprises wooden support straps affixed to the beams on a side of the beam opposite the beam ties.

3. The roof structure of claim 1, wherein the height of the beams measured from a lower beam to a top beam is approximately 12 inches.

4. The roof structure of claim 1, wherein the beam ties have dimensions of approximately 11×3½×½inches.

5. The roof structure of claim 1, wherein the wooden straps have dimensions of approximately 2½ by 11 by ½ inches.

6. The roof structure of claim 1, wherein the beams are of the type known as 2-by-4 beams.

7. The roof structure of claim 1, wherein the beam ties are wooden.

8. The roof structure of claim 1, wherein the beam ties are metal.

9. The roof structure of claim 1, wherein the support blocks are spaced apart approximately 16 inches from the next support block.

10. The roof structure of claim 1, wherein the beams are connected to the truss through metal truss plates having nail holes.

11. The roof structure of claim 1, wherein clips are used to connect beams to the truss.

12. The roof structure of claim 1, wherein the beam ties, beam, truss and support blocks are comprised of wood.

13. A truss assembly comprising:

a wooden truss comprised of a pair of sloped top chords meeting at a peak and a web of beam members forming triangular structures connected to the top chords; and a wooden joist comprised of a pair spaced apart beams spaced by a plurality of spaced apart blocks joined to the beams at intervals and extending in parallel from one sloped top chord to the other;

a plurality of beam tie members affixed along the length of the beams, the beam tie members being formed in symmetric pairs, each member comprising a symmetric truncated mirror image parallelogram forming an irregular hexagon, the tie members having mutually facing noses and a height that is approximately the same as the spaced apart beams, wherein the beam tie pairs are adjacent to each other appearing as tiles that abut the beams and mutually abut in the space between beams thereby adding strength and load support to the joist.

14. The truss assembly of claim 13, wherein the beam ties are wooden.

15. The truss assembly of claim 13, wherein the beam ties are metal.

16. The truss assembly of claim 13, wherein the beam tie pairs are aluminum.

17. A roof structure comprising:

a roof truss made of beams having a width and a span; and a joist supporting the roof truss, that joist having, a pair of coextensive, spaced apart beams having parallel lengths, widths and a height, at least as long as the span of the truss, the beams spaced by a plurality of spaced apart blocks joined to the beams at intervals;

a plurality of beam tie members affixed along the length of the beams, the beam tie members being formed in symmetric pairs of congruent irregular hexagons having a height that is approximately the same as the spaced apart beams, the pairs being symmetric truncated mirror image parallelograms forming the hexagons with mutually facing and abutting noses, whereby the beam ties form tiles that abut the beams and mutually abut in the space between the beams thereby adding strength and load support to the joist.

18. The roof structure of claim 17, wherein the extent of nose-to-nose abutment of the noses of tie members is at least one-third of the height of the irregular hexagons.

19. A method of forming a joist for a truss comprising:

stacking two parallel coextensive beams having a length spanning a truss dimension where support is designed, the beams having a non load bearing surface;

joining the beams along the non load bearing surface, with ties fastened to the two beams, the ties being formed in symmetric pairs, each member of each of the ties comprising a symmetric truncated mirror image parallelogram forming an irregular hexagon and having mutually facing and abutting noses, the ties being tiled to have a corrugated shape along the beam length mutually abutting in the space between the beams thereby forming a truss joist, the corrugated tiles having a height that is approximately the same as the spaced apart beams.

20. The method of claim 19 further defined by forming the ties as abutting irregular hexagons.

* * * * *